United States Patent [19]

Kuroda et al.

[11] 4,268,940

[45] May 26, 1981

[54] PROCESS AND APPARATUS FOR CRIMPING FILAMENT YARN

[75] Inventors: Toshimasa Kuroda, Takatsuki; Mitsuo Matsumoto, Ibaraki, both of Japan

[73] Assignee: Teijin Limited, Osaka, Japan

[21] Appl. No.: 974,463

[22] Filed: Dec. 29, 1978

[30] Foreign Application Priority Data

May 16, 1978 [JP] Japan ..... 53-57128

[51] Int. Cl.[3] ..... D02G 1/12

[52] U.S. Cl. ..... 28/255; 28/221; 28/267; 28/276

[58] Field of Search ..... 28/255, 221, 267, 276

[56] References Cited

U.S. PATENT DOCUMENTS

| | | | |
|---|---|---|---|
| 3,729,831 | 5/1973 | Kosaka et al. | 28/255 X |
| 3,802,038 | 4/1974 | Bauch et al. | 28/255 |
| 3,802,039 | 4/1974 | Bauch | 28/255 |
| 3,810,285 | 5/1974 | Ferrier et al. | 28/255 X |
| 3,852,857 | 12/1974 | Ethridge et al. | 28/255 |
| 3,956,807 | 5/1976 | Holland | 28/255 |
| 3,982,310 | 9/1976 | Beck et al. | 28/255 |
| 3,983,610 | 10/1976 | Eskridge et al. | 28/255 |
| 4,040,153 | 8/1977 | Hatcher et al. | 28/255 X |
| 4,148,179 | 4/1979 | Becker et al. | 28/255 X |
| 4,188,691 | 2/1980 | Matsumoto et al. | 28/255 |

FOREIGN PATENT DOCUMENTS

| | | | |
|---|---|---|---|
| 2061814 | 7/1972 | Fed. Rep. of Germany | 28/255 |

*Primary Examiner*—Robert Mackey

*Attorney, Agent, or Firm*—Sughrue, Rothwell, Mion, Zinn and Macpeak

[57] ABSTRACT

Process and apparatus for controlling a filament pad in the stuffing chamber of a pneumatic crimper and for imparting an improved filament cohesion to the crimped filament yarn within said crimper.

10 Claims, 6 Drawing Figures

PROCESS AND APPARATUS FOR CRIMPING FILAMENT YARN

BACKGROUND OF THE INVENTION

The present invention relates to the crimping of a filament yarn and more particularly to a process and an apparatus for crimping a filament yarn.

In recent years, in case of crimping a filament yarn, a so-called air stuffing crimping, which introduces a hot fluid entrained filament yarn into a stuffing chamber by use of a fluid jet nozzle, has been studied, because of its high-speed crimping ahnd compactness of its apparatus.

According to the conventional methods of air stuffing crimping, high-speed crimping of filament yarn is possible, because the filament yarn is crimped efficiently by being plasticized with a hot fluid inside the hot fluid jet nozzle, and also by being subjected to hot fluid turbulence and then being stuffed into the stuffing chamber.

Moreover, the apparatus for air stuffing can be made very compactly with its stuffing chamber combined with a hot fluid jet nozzle.

However, in case of the above-mentioned process, it is very difficult to produce uniformly crimped yarn, because qualities of obtained crimped filament yarn, for example, crimp percentage, number of crimps, modulus of crimp, etc., are inclined to vary due to fluctuations occurring with the position of the stuffing start point (distance from the hot fluid jet nozzle to the filament yarn block already packed tightly in the stuffing chamber), stuffing density of filament yarn, releasing point, cooling of crimped filament yarn and so on.

From the above viewpoint, attempts have been made to facilitate crimp fixing of filament yarn by the application of a cold fluid supplied into the stuffing chamber from an opposite direction, also of back pressure caused by the cold fluid on the filament yarn packed in the stuffing chamber (see U.S. Pat. No. 3,802,038, U.S. Pat. No. 3,849,844, Japanese Patent Application Laid-open No. 71242/74, Australian Pat. No. 74/76203, U.S. Pat. No. 3,824,656).

However, these processes are so composed as to let both the hot fluid and the cold fluid exhaust from the stuffing chamber, therefore it is difficult to keep the pressure balance between the hot fluid and the cold fluid under control, and any pressure unbalance thus occurring inevitably varies the position of the stuffing start point in the stuffing chamber, stuffing density, releasing point and so on.

In order to prevent these phenomena, means for controlling the pressure of both the hot and the cold fluid in said stuffing chamber have been proposed by providing a pressure control valve on the exhausting conduit of the stuffing chamber, but the system of this apparatus is complicated and unpractical (see U.S. Pat. No. 3,802,038, U.S. Pat. No. 3,849,844). Another defect to be noted from the aspect of handling property of the crimped filament yarn is that it has little filament cohesion when it comes out from a crimping apparatus. This means in turn that a tufting process becomes less efficient in case that the crimped filament yarn is used as a pile yarn for a carpet in a non-twisted state.

One proposal for overcoming the above mentioned defect made heretofore is to subject the crimped filament yarn to an intermingling treatment subsequent to being withdrawn from a crimping apparatus and before being wound-up as disclosed in U.S. Pat. No. 3,982,310.

This process however, requires a separate and additional step for the intermingling of the filaments. Moreover, this intermingling process is considerably expensive for the use of high pressure fluid and also the strict dimension of a jet nozzle.

SUMMARY OF THE INVENTION

It is a general object of the present invention to overcome the disadvantages of the prior art.

It is an object of the present invention to provide an efficient process for fluid stuff-crimping of a filament yarn in which the filament yarn can be imparted a uniform crimp and also a desirable cohesion required during a tufting process.

It is another object of the present invention to provide a compact apparatus for fluid stuff-crimping of the filament yarn which is suitable for carrying out the above process.

As a result of extensive research, it has now been discovered that a well crimped yarn can be obtained under an extremely stable operation when a cold fluid for cooling a crimped yarn is exhausted through venting ports of a staying control chamber for a filament pad disposed in communication with a stuffing chamber downstream thereof and further the crimped filament yarn can be imparted a desirable cohesion efficiently by a compact arrangement when an intermingle nozzle is unified to a downstream end of the staying control chamber in such manner that the cold fluid is injected into the intermingle nozzle to give the crimped filament yarn being withdrawn from the filament pad a filament cohesion and then the injected cold fluid is forced into the staying control chamber.

In order that this invention may be more fully understood, the process and apparatus will now be described with reference to the accompanying drawings.

DESCRIPTION OF THE INVENTION

Figure 1:
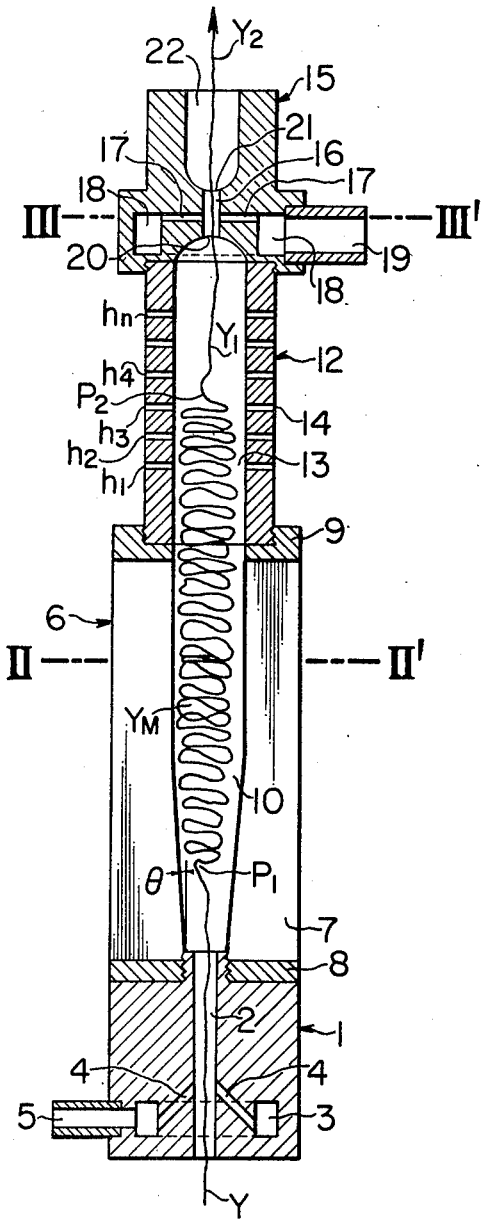
FIG. 1 is a diagrammatic longitudinal section illustrating an embodiment of an apparatus in accordance with the present invention.

Turning to FIGS. 1 through 5, the apparatus for use in conjunction with this invention is essentially composed of a hot fluid jet nozzle 1, stuffing chamber 10 having means for exhausting a hot fluid and a, stying control chamber 13 having means for exhausting a cold fluid, an intermingle nozzle 15. The hot fluid jet nozzle 1 contains a yarn processing bore 2 flared at its downstream extremity, a hot fluid plenum chamber 3 surrounding said yarn processing bore 2 and a hot fluid jet bore 4 extending from said plenum chamber 3 and symmetrically disposed at a forwarding angle to the longitudinal axis of the yarn processing bore 2.

Further, a hot fluid conduit 5 is connected with the said plenum chamber 3 into which a heated fluid under high pressure is supplied through said conduit 5.

Figure 2:
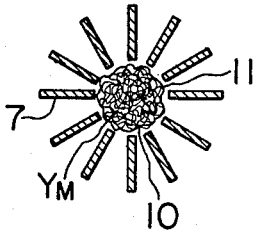
FIG. 2 is a cross section taken on line II–II' of FIG. 1.

This hot fluid jet nozzle 1 is secured to a stuffing vessel 6 which is made of an assembled unit of lamellae 7 arranged in a radially extending form as illustrated in FIG. 2 and the ends of said lamellae 7 along the longitudinal direction are fixed, for example, by mean of plugs 8 and 9, respectively, whereby a stuffing chamber 10 is formed inside the lamellae arrangement. Also a spacement 11 is formed between adjacent lamella for the purpose of radial escape of the hot fluid.

At the downstream end of the stuffing vessel 6, a cylinder 12 is screwed into the plug 9. Said cylinder is provided with a plurality of outlet orifices 14 along the length thereof for radial escape of a cold fluid wherein a staying control chamber 13 is formed inside of the cylinder 12, said orifices being arranged in multiple stage $h_1$–$h_n$ as shown in FIG. 1.

Figure 3:
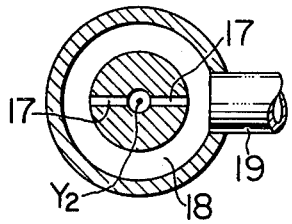
FIG. 3 is a cross section taken on line III–III' of FIG. 1.

Further, an intermingle nozzle 15 is also screwed onto the extremity of said cylinder 12 which has a yarn intermingle bore 16 around which an annular chamber 18 is provided and a cold fluid jet bore 17, in opposed position is located between said bore 16 and said annular chamber 18 as illustrated in FIG. 3. Also, a cold fluid supply conduit 19 is connected with said annular chamber whereby said cold fluid is injected into said yarn intermingle bore 16 through the cold fluid jet bore 17. Further, the upstream end of the yarn intermingle bore 16 forms an opening 20 for the staying control chamber and the downstream end of the said bore 16 forms an opening 21 for a yarn outlet passageway 22.

In operation, yarn Y, preferably in pre-heated state by turning it around a hot roll (not shown), is entrained in the yarn processing bore 2. The yarn is intimately and uniformly contacted to be plasticized by the hot fluid through the hot fluid jet bore 4. The yarn is then forwarded by the hot fluid into the stuffing chamber 10. Then the yarn is impinged onto a filament pad $Y_M$ already stuffed in the chamber to form crimps. This impinging point is designated as $P_1$ which is referred to as "as stuffing start point" hereinafter.

Hot fluid introduced into the stuffing chamber 10 together with yarn is exhausted outwardly through the spacing 11 formed among the lamellae as it flows along the proceeding direction of the filament pad $Y_M$.

The continuously formed filament pad $Y_M$ moves toward and extends into the staying control chamber 13, while the cold fluid is supplied into the staying control chamber 13 from an opposite direction through a yarn intermingle bore via a cold fluid jet bore 17. Consequently, a back pressure arises and acts upon the downstream end of the filament pad $Y_M$. At the same time, the cold fluid flowing backwardly assists the increment of crimping and also the cooling of filament pad $Y_M$, and this cold fluid is vented radially through the plurality of small outlet orifices, which works as the cold fluid exhausting conduit disposed in the wall of the hollow cylinder 12.

With regard to the withdrawal of the crimped filament yarn, it is released from the filament pad $Y_M$ at the releasing point designated as $P_2$ which lies within a longitudinal area extending from the small outlet orifice $h_1$ to the small outlet orifice $h_n$.

Thus the crimped filament yarn $Y_1$ is withdrawn toward the yarn outlet passageway 22 through the yarn intermingle bore 16. As explained before, the cold fluid under high pressure is injected into said bore 16 through the cold fluid jet bore 17, the crimped filament yarn $Y_1$ being withdrawal is subjected to an intermingling treatment when it passes the yarn intermingle bore 16. Then the yarn, which is imparted a filament cohesion useful during tufting, proceeds toward a winding device (not shown) via the yarn outlet passageway.

As can be clearly seen from the above explanation, the gist of the present invention resides in an adoption of an intermingle nozzle forming a part of a pneumatic crimper wherein a cold fluid injected into said nozzle contributes to an improvement in filament cohesion in addition to disposing a back pressure acting upon a filament pad.

The back pressure on the filament pad can be automatically controlled according to the invention to result in a stable crimping operation. This is further explained in detail.

The filament yarn pad formed in the stuffing chamber 10 moves toward the staying control chamber 13, while the cold fluid is supplied into the staying control chamber 13 from an opposite direction through the yarn intermingle bore 16 of the intermingle nozzle 15 whereby the back pressure arises upon the downstream end of said pad.

When the filament yarn $Y_1$ is released from the filament yarn pad in the staying control chamber 13 at a point upstream of the releasing point $P_2$, for instance, at the point around perforation $h_2$, the volume of exhausting cold fluid increases, thus lowering the back pressure caused by the cold fluid, which causes the releasing point $P_2$ to resume its previous position.

On the contrary, when the filament yarn $Y_1$ is released from the filament yarn pad at a point downstream of the releasing point $P_2$, for instance, at the point near the orifice $h_4$, the volume of the exhausting cold fluid decreases, thus rasing the back pressure, which pushes down the point $P_2$, thus always controlling point $P_2$ to stay at the proper position.

The standardization of both the cooling condition and the back pressure is accordingly effected satisfactorily.

Consequently, the pressure balance between the hot fluid and the cold fluid is effectively controlled, the stuffing start point $P_1$ is standardized, and moreover, unevenness in the stuffing density, volume of the filament yarn, working time and so on in the stuffing chamber and the staying control chamber is much less liable to occur.

The present invention has successfully made it possible to achieve crimping efficiency much higher than usual fluid crimping in producing uniform crimped filament yarn with a desiable filament cohesion by bringing the staying control chamber combined with the intermingle nozzle into the apparatus adjacent the stuffing chamber, whereby the hot fluid is exhausted from the stuffing chamber and the cold fluid from the staying control chamber, respectively.

In carrying out the process of the present invention, although the pressure and temperature of the hot fluid, of course, vary depending upon the filament yarn being treated, the hot fluid, preferably hot air under pressure ranging from 2 to 10 kg/cm$^2$, and temperature 150°–300° C., preferably from 3 to 8 kg/cm$^2$, and 180°–250° C., or steam under pressure ranging from 3 to 20 kg/cm$^2$ and temperature of 130°–250° C., preferably from 4 to 10 kg/cm$^2$ and 160°–230° C. is employed.

A thermometer may be inserted into the hot fluid plenum chamber 3 in order to regulate the hot fluid by a temperature indicator controller (not indicated in the drawings).

Preferred advancement speed or feed rate of the filament yarn into the yarn processing bore of the hot fluid jet nozzle is in the range of 300 to 4,000 meters per minute, preferably 1,000 to 3,000 meters per minute. The distance between the end of the yarn processing bore and the stuffing start point $P_1$ is 0–50 mm, preferably 5–25 mm.

When said distance exceeds 50 mm, the resulting filament yarn can not be crimped well and a lack of crimping uniformity in the filament yarn occurs.

As to the filament pad $Y_M$, the stuffing density of 0.05–0.4 g/cm$^3$, preferably 0.1–0.3 g/cm$^3$, and the residence time in the stuffing chamber and the staying control chamber ranging from 0.1 to 5 seconds, preferably from 0.4 to 3.0 seconds are recommended.

The cold fluid may be cold air, cold nitrogen, steam whose temperature is lower than the hot fluid, and air are preferably used. Considering the intermingling efficiency of the filaments and the back pressure on the filament pad, the above media is controlled to have a pressure of 0.4–5.0 kg/cm$^2$, preferably 1.0–4.0 kg/cm$^2$, and a temperature of 0°–100° C., preferably 20°–40° C.

The cold fluid may also be made to contain water, preferably sprayed water in order to have the crimp fixing improved by thus modified cooling and, on the other hand, to retard excess increment of crimping as disclosed in the U.S. Pat. No. 3,271,493.

Likewise, a solution of coloring matter or finishing oil may be admixed with the cold fluid so that after treatment processes may be omitted.

Turning to the apparatus, to obtain the efficiency in effecting prompt and smooth guiding of the filament yarn Y as well as its knots into the yarn processing bore 2, its diameter ($P_D$) should be 1.5 mm or more ($P_D \geqq 1.5$ mm).

In the case of high speed crimping, where the feed rate is 1,500 meters per minute or higher, especially in the case of continuous threading of high speed processing yarn into the yarn processing bore 2 in a direct spinning-drawing-texturing (or crimping) yarn process (SDTY) and the like, the yarn processing bore 2 should have a diameter of 1.8 mm or more, preferably 2.6 mm or more.

The ratio of the diameter ($P_d$) of the hot fluid jet bore 4 to the diameter ($P_D$) of the yarn processing bore 2 should be less than 0.8, preferably less than 0.7 ($P_d/P_D \leqq 0.8$).

The diameter ($P_d$) of the hot fluid jet bore 4 should be more than 1.0 mm taking the suction tension of the filament yarn into consideration, and more than 1.5 mm, preferably 1.7 mm in case of high speed crimping ($P_d \geqq 1.0$ mm).

When the diameter ($P_d$) is less than 1.0 mm, the entraining power of the hot fluid drops resulting in the decrease of tension of the filament yarn even when the hot fluid pressure is raised. The tension drop in the filament yarn before it enters into the yarn processing bore frequently induces the wrapping of filament yarn around the feed rolls set in front of the crimping apparatus.

Further, the diameter ($P_D$) is preferably less than 6 mm, more preferably 3 mm in order to maintain the dense crimp uniformity of the resulting crimped yarn. Moreover, the hot fluid jet bore 4 is disposed in plurality at an angle of approximately from 10° to 50°, preferably 20° to 40° with the axis of the yarn processing bore 2 as in the case of conventional hot fluid jet nozzles.

The hot fluid jet nozzle 1 according to this invention should not necessarily be construed as limiting the spirit of this invention.

For example, a hot fluid jet nozzle suitable for crimping in accordance with this invention may be any hot stream fluid jet nozzle disclosed in Japanese Patent Publication No. 3867/73, or any hot turbulent fluid jet nozzle disclosed in U.S. Pat. No. 3,186,155.

At any rate, the size of the hot fluid jet nozzle for use in conjunction with this invention may be selected in accordance with the kind of the filament yarn, total denier and crimping conditions and so on.

The stuffing chamber 10 is usually made of an assembled unit of lamellae 7 as illustrated in FIG. 2, having lamellae ranging from 10 to 30 in number, preferably from 12 to 24, provided radially extending from the plug 8 to the plug 9.

Although crimping conditions vary depending upon the total denier of the filament yarn to be treated, the space 11 between lamellae 7 at their root, where the stuffing chamber 10 is formed, is preferably from 0.3 mm to 2 mm, and each lamella is preferably from 0.5 mm to 2 mm thick.

When the space is not more than 0.3 mm, the filament yarn is apt to be caught in the space. On the other hand, when the space is more than 2 mm, the filament yarn bulges from the space.

And it is important to have the configuration of the lamella so designed as to make a narrow entrance for the stuffing chamber forming a flare at an angle of $\theta_1$ for approximately half of the whole length of the stuffing chamber; thereafter the lamellae form a cylindrical chamber.

The angle of $\theta$ ranges from 0.5° to 5°, preferably 1° to 3°, and the lamellae 7 are disposed to form the entrance to the stuffing chamber ranging from 2 mm to 20 mm in diameter, preferably 3 mm to 12 mm, and the exit ranging from 4 mm to 40 mm in diameter, preferably from 8 mm to 12 mm.

The length of lamellae 7 may be more than 10 mm in length, preferably from 100 mm to 200 mm.

When the longitudinal section of the stuffing chamber 10 is gradually widened wedgewise toward the exit, the filament yarn pad $Y_M$ is thermally set at the entrance of the stuffing chamber 10 and makes loose travel through the stuffing chamber 10 meandering towards the exit, thus losing much of the crimp uniformity of the filament yarn.

Incidentally, it should also be understood that means of comprising the stuffing chamber in this invention are explained in connection with lamellae but they should not be construed as limiting the spirit or scope of this invention.

For instance, the stuffing chamber of this invention may be made of a plurality of rod materials which are arranged radially to form a chamber, a cylinder having multi perforations radially disposed in the walls, or a cylindrical wire netting.

Next, the staying control chamber 13 is composed of the hollow cylinder 12 having plural orifices 14 disposed radially in the wall thereof and arranged in $h_1$–$h_n$ as each orifice 14 should be not more than 3 mm in diameter, preferably from 0.8 mm to 2 mm.

The inside diameter of the hollow cylinder 12 must be larger than the inside diameter of the stuffing chamber at the plug 9. If not, the filament yarn block $Y_M$ in the stuffing chamber 10 is hindered to make a smooth transition into the staying control chamber.

Although the inside diameter of the hollow cylinder 12 varies depending upon the diameter of the stuffing chamber 13, it may range from 5 mm to 45 mm, preferably from 9 mm to 15 mm.

Staying chamber length varies depending upon the uniformity of the filament yarn; it may range from 10 mm to 200 mm, preferably from 50 mm to 100 mm.

In the illustrated embodiment (FIG. 1), the staying control chamber is composed of a hollow cylinder tube having many perforations disposed in the walls, but this should not be construed as limiting the spirit or scope of this invention. For example, similar to the above-mentioned stuffing chamber, the staying control chamber may be composed of a plurality of lamellae or rod materials, which are arranged radially side by side.

That is to say, any of such staying control chamber can be applied to this invention, if said chamber is made to control the exhausting volume and the back pressure of the cold fluid in response to the longitudinal movement of the releasing point $P_2$.

The staying control chamber 13 may also be surrounded by a cover having the cold fluid exhausting conduit on it.

It is stressed again that the cold fluid jetted into the staying control chamber 13 from an opposite direction yarn processing direction emanates from the yarn intermingle nozzle 15 in which the crimped filament yarn $Y_1$ is subjected to whirling action of said fluid in order to be intermingled. Then the cold fluid is forced into the staying control chamber 13.

This results in cooling and fixing the crimped filament yarn in the staying control chamber and makes it easy to release the crimped filament yarn from the filament yarn pad $Y_M$.

Moreover, it is important that the apparatus of this invention can standardize the position of $P_2$ of the filament yarn block in the staying control chamber.

Consequently, this also results in the standardization of the position of the stuffing start point $P_1$ which is responsible for controlling the control factors in the crimping such as stuffing density, releasing point and so on.

Generally, the intermingle nozzle comprises an intermingle bore 16 through which a filament yarn is withdrawn and at least two discrete jet bores (17) are arranged symmetrically and disposed, preferably at right angles to the axis of the intermingle bore 16, so as to direct the cold fluid into said intermingle bore 16 and also into the staying control chamber 13. The diameter of the intermingle bore 16 ranges generally from 2 mm to 4 mm in case that a yarn having denier of 1200–2700 is introduced into the crimper, the length of the same ranges from 3 mm to 20 mm. Also, the cross section of the bore 16 can be round, oval, etc. In the case of oval section, the ratio of minor axis to major axis is preferably from 1.4 to 0.6.

Regarding the cold fluid bore 17, the diameter is from 1.26 mm to 3.14 mm.

Figure 4:
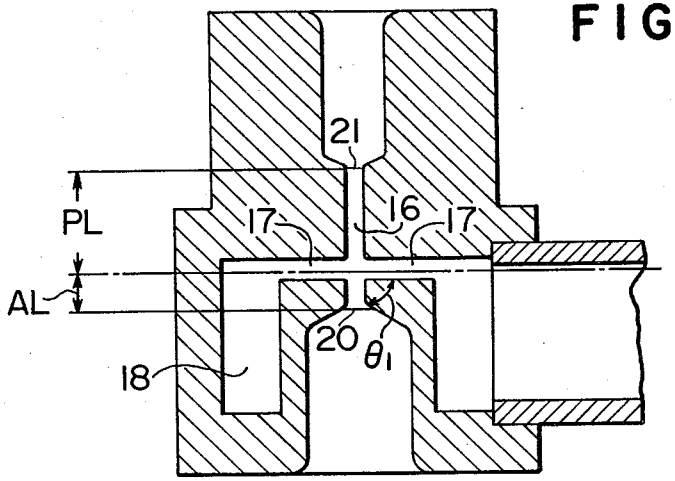
FIG. 4 is a diagrammatic longitudinal section of an intermingle nozzle.

The above is one of the examples with regard to the intermingle nozzle generally suitable for the invention and does not limit the scope of the invention. However, other dimensions are required for high speed crimping more than 1500 m/min. under which the intermingling (interacing) effect tends to decrease to the extreme degree. In order to maintain the same intermingle effect as is obtained under lower crimping speed, an intermingle nozzle satisfying following conditions is more preferably used and this type of nozzle is shown in FIG. 4.

$$1.23 \geqq K \geqq 0.80 \quad \text{(a)}$$

$$0.90 \geqq AL/PL \geqq 0.05 \quad \text{(b)}$$

$$20 \geqq PL(mm) + AL(mm) \geqq 3 \quad \text{(c)}$$

$$100° \geqq \theta_1 \geqq 60° \quad \text{(d)}$$

In the above, K is the ratio of the total cross sectional area of the cold fluid jet bores 17 to the area of the yarn intermingle bore 16, PL is a distance between the center of the cold fluid jet bore 17 and the outlet extremity 21 of the yarn intermingle bore 16, AL is a distance between the center of the cold fluid jet bore 17 and the inlet extremity 20 of the yarn intermingle bore 16 and $\theta_1$ is an angle between the cold fluid jet bore 17 and the yarn intermingle bore 16 at the inlet side, as illustrated in FIG. 4.

Of the conditions listed above, the condition (b) is the most important one because the value defined by the equation contributes to ideal distribution of the cold fluid into the staying control chamber 13 and toward the outlet passage way 22. The driving force is additionally imposed on the yarn running toward the outlet passage way 22 in case that AL/PL takes a value more than 0.5, i.e. the length of PL is longer than that of AL.

Finally, the diameter of outlet passageway 22, which ensures stable withdrawal of the yarn $Y_2$ is from about 3 mm to 35 mm, preferably 4 mm to 8 mm. Preferably, its value should be less than the inside diameter of staying control chamber. Also, it may have 10 mm–50 mm length.

The process according to this invention can be carried out by use of any apparatus comprising a hot fluid jet nozzle, stuffing chamber having a hot fluid exit, staying control chamber having a cold fluid exit, and an intermingle nozzle acting concurrently as a cold fluid supply means set up in said order into an assembly.

For example, the basic design of the apparatus according to this invention can also be applied to a crimping apparatus which is constructed to have the whole apparatus divided axially into two portions, a body and a detachable cover, and also the cross section of the yarn processing bore, stuffing chamber, and/or staying control chamber may be made rectangular.

Figure 5:
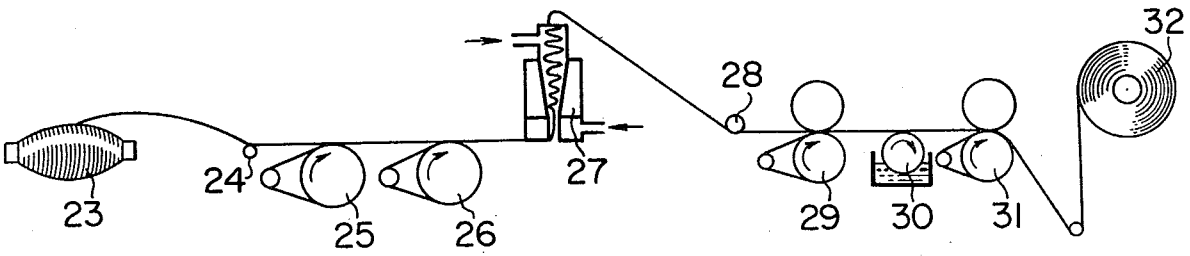
FIG. 5 is a schematic view of a process according to the invention.

Turning to FIG. 5, a schematic view of the present process is shown there using the apparatus of FIG. 1.

The filament yarn Y drawn from a pirn 23 is fed via feed rolls 25, preheated on the hot feed rolls 26 running at a constant rate, after it has passed its way via the guide 24 and overfed into the crimping apparatus 27.

Thus, crimps are formed in the filament yarn. Then, the filament yarn is drawn by means of take-up rolls 29 at a constant rate lower than that of the rolls 26 via the guide 28, oiled by means of the oiling roll 30, stretched and opened by means of the draft rolls 31 at a constant rate faster than that of the rolls 29, and then taken up into a package on the winder 32.

In FIG. 5, the invention is described in the event of the throwster texturing yarn process (TTY), but should not be limited to this process.

The invention may be applied not only to the drawing/texturing yarn process (DTY), but also to the spinning/drawing/texturing yarn process (SDTY). Especially, this invention may be preferably applied to the spinning/drawing/texturing yarn process because of its high speed crimping efficiency achieved by this apparatus.

As for the filament yarns suitable for the process and apparatus according to this invention, any of thermoplastic filament yarns, such as polyamides (poly-ε-caprolactam, polyhexamethylene adipamide, etc.), polyesters (polyethylene terephthalate, polybutylene terphthalate, etc.), polyolefines (polyethylene, polypropylene, etc.), and polyvinyls (polyvinyl chloride, polyacryronitrile, etc.), are applicable. Preferred denier of the filament yarn is in the range of 30 to 5000.

As described hereinabove, this invention relates to apparatus and process comprising forcing the hot fluid entrained filament yarn into the stuffing chamber in one direction, forcing the cold fluid from an opposite direction into the staying control chamber located behind the stuffing chamber by mean of an intermingle nozzle, exhausting the hot fluid from the stuffing chamber and the cold fluid from the staying control chamber, which structure causes and applies constant back pressure throughout the staying control chamber and the stuffing chamber, enhances the increment of crimping in the filament yarn, and standardizes the position of the stuffing start point $P_1$ and releasing point $P_2$.

Consequently, it is possible to keep the stuffing density and stuffing volume of filament yarn in the stuffing chamber and staying control chamber to a specified degree to provide substantially much more uniform crimping with less problems than the prior art. Still, the filament yarn taken off from the apparatus has the good spreading quality, and the resulting crimped filament yarn has an improved filament cohesion which provides good tufting properties in the preparation of carpets.

This invention will now be described by referring to an example.

EXAMPLE 1

In the example the apparatus as shown in FIGS. 1–5 was used without the oiling roll 30 and the drafting rolls 31 indicated in FIG. 5, and a 1050 denier/68 filament drawn polycaprolactam yarn was subjected to crimping process under conditions shown in Table 1. Results are shown in Table 1.

The values shown as "total crimp (TCo)" and "filament cohesion" in the table were measured and calculated in the following manner:

(1) Total Crimp

Samples of crimped filament yarns were collected in a specified length. Then a load of 0.1 g/d was imposed on the sample and the length ($l_0$) thereof was measured.

The load was removed from the sample and the sample was dipped in boiling water for 20 minutes in the relaxed state to develop crimps further. Then the sample was taken up from the water and was allowed to stand so as to dry itself naturally. A load of 0.1 g/d was imposed on the sample and the length ($l_1$) thereof was measured. Then the load was removed from the sample and a load of 2 mg/d was imposed on the sample and the length ($l_2$) thereof was measured.

The value of the total crimp (TCo) was calculated from the following equation:

$$TCo = (l_1 - l_2)/l_o \times 100(\%)$$

(2) Filament cohesion

This is, in other words, designated as "coherent factor" or "Interlace Number".

The method for measurement of this value is described in detail in U.S. Pat. No. 2,985,995 (Column 20, line 56 through column 21, line 41.)

TABLE 7

| Item | | Condition |
|---|---|---|
| Yarn overfeed (%) | | 18 |
| Feed rolls (25) | Peripheral speed (m/min) | 1940 |
| Hot feed | Temperature (° C.) | 200 |
| rolls (26): | Peripheral speed (m/min) | 2000 |
| Hot fluid | Temperature (° C.) | 245 |
| (air): | Pressure (kg/cm$^2$) | 4 |
| Yarn processing | Diameter (mm) inlet | 2 |
| bore (2): | outlet | 3 |
| | Length (mm) | 55 |
| How fluid jet bores (4) diameter (mm) | | 1.9 |
| Angle (degree°) between yarn processing bore and hot fluid jet bores: | | 30° |
| Lamellae 7: | Number | 12 |
| | Thickness (mm) | 1 |
| Stuffing chamber: | Entrance, diameter (mm) | 5 |
| | Exit, diameter (mm) | 11 |
| | Length (mm) | 150 |
| Angle θ (degree°) | | 2° |
| Staying control | Diameter (mm) | 14 |
| Chamber: | Length (mm) | 80 |
| Control perforation: | Diameter (mm) | 1 |
| (Orifice) | Number per line | 4 (symmetrically disposed) |
| | Number of lines | 15 |
| Intermingle nozzle (FIG. 4): | | |
| | Intermingle bore (16) | |
| | Diameter (mm) | 3 |
| | Length (mm) | |
| | PL (mm) | 7 |
| | AL (mm) | 3 |
| | AL/PL | 0.43 |
| | PL + AL | 10 |
| Cold fluid jet bores: | Number | 2 |
| | Diameter (mm) | 2 |
| | Angle $\theta_1$ (degree°) | 90° |
| | K | 0.89 |
| Cold fluid (air): | Temperature (° C.) | 25 |
| | Pressure (kg/cm$^2$) | 4.0 |
| Outlet passageway: | Length (mm) | 30 |
| | Diameter (mm) | 7 |
| Take-up rolls (29): | Peripheral speed (m/min) | 1640 |
| Crimped filament | Denier (de) | 1250 |
| yarn obtained: | Total crimp (TCo, %) | 12.3 |
| Filament cohesion: | | 22 (per meter) |

The crimped filament yarn thus obtained in Example 1 was subjected to a tufting operation in order to make two types of carpets, a plain loop carpet and a high and low loop carpet (H/L).

To speak of the quality of the tufted carpets thus prepared, the latter had a clear H/L pattern, and the tops of loop piles were tufted uniformly to make an even surface to give a carpet having good quality and appearance.

Incidentally, the distance from the end of the yarn processing bore to the stuffing start point $P_1$ was constantly kept about 13 mm long in Example 1. The same apparatus used in Example 1 with the use of a hollow cylinder as the stuffing chamber but with orifices disposed in the walls, was utilized for preparing crimped filament yarn under the same conditions, which, however, resulted in a constant fluctuation of the above-mentioned distance ranging from 0 to 30 mm, and a lack of crimp uniformity and unevenness of dyeing in the crimped filament yarn. The obtained crimped filament yarns was subjected to the tufting operation in same way as in Example 1 and the tufted carpet prepared therefrom had an uneven surface, and was found utterly impractical.

Another comparative example was carried out as the same manner in Example 1 except that the intermingle nozzle was not operated for the cold fluid and a hollow cylinder 12 without orifices was employed wherein a pair of cold fluid jet bores were provided at the end portion of the cylinder so as to direct the cold fluid into the stuffing chamber in a direction contrary to the direction of yarn travel.

The obtained crimped filament yarn had a filament cohesion of 5/meter and was unsuitable for preparing tufted carpet without prior twisting or additional intermingling. Also, the crimped filament yarn showed uneven dyeing property upon dyeing the same, and during crimping, a feed yarn frequently broke in the yarn processing bore 2 due to a remarkable fluctuation of the stuffing start point $P_1$, thus the crimping had to be carried out under extremely unstable state.

EXAMPLE 2

Crimping was carried out as in Example 1 except that K value (the ratio of the total cross sectional area of the cold fluid jet bores 17 to the area of the yarn intermingle bore 16) was varied ranging from 0.5 to 1.25 to examine the dependency of K upon the intermingle effect of the crimped yarn.

Figure 6:
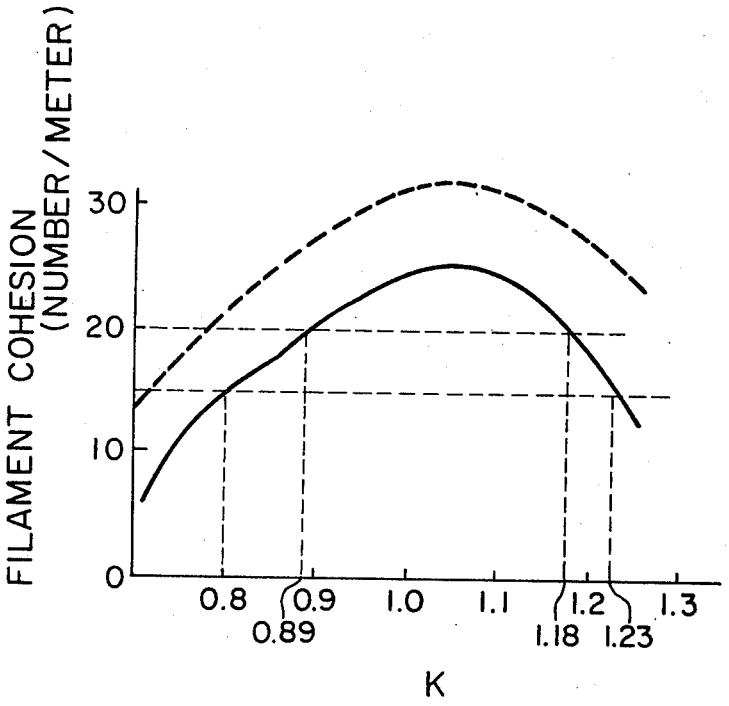
FIG. 6 is a graphical representation of the relationship between filament cohesion (number/meter) and the K value (ratio of total cross-sectional area of the cold fluid jet bores to the area of the yarn intermingle bore) according to the invention for two different crimping speeds.

The result is shown in FIG. 6 from which it can be seen that the range of 0.8 to 1.23 gave filament cohesion more than 15 desirable for tufing of the crimped yarn even under the crimping speed of 2000 m/min.

Additionally, the curve plotted in broken line shows the result under the crimping speed of 900 m/min.

We claim:

1. In a process for fluid crimping filament yarn comprising forcing a hot fluid entrained filament yarn into a stuffing chamber in one direction to form a filament pad which extends into a staying control chamber downstream of said stuffing chamber, forcing a cold fluid into said staying control chamber from an opposite direction, exhausting the hot fluid from a hot fluid outlet located in said stuffing chamber, and exhausting the cold fluid through a plurality of exhaust orifices located in series along the length of said staying control chamber whereby the end of said filament yarn pad in said staying control chamber controls the number or orifices exposed for outlet of said cold fluid to control the back pressure acting on the filament yarn pad, the improvement comprising withdrawing the filament yarn from the end of said staying control chamber opposite said stuffing chamber through a yarn intermingle bore having a diameter less than the diameter of said staying control chamber and imparting a filament cohesion to the yarn by injecting said cold fluid into said yarn intermingle bore against said yarn through at least two cold fluid jet bores which are symmetrically and radially disposed at right angles to the yarn intermingle bore and which intersect said yarn intermingle bore between the midpoint of said yarn intermingle bore and said staying control chamber with the ratio of the total cross-sectional area of said jet bores to the cross-sectional area of said yarn intermingle bore being from 0.80 to 1.23.

2. The improvement of claim 1 wherein said hot fluid is hot air at a pressure ranging from about 3 to 8 $kg/cm^2$ and a temperature ranging from about 180° to 250° C.

3. The improvement of claim 1 wherein said hot fluid is steam at a pressure ranging from about 4 to 10 $kg/cm^2$ and a temperature ranging from about 160° to 230°.

4. The improvement of claim 1 wherein said cold fluid is air at a pressure ranging from about 1.0 to 4.0 $kg/cm^2$ and a temperature ranging from about 20° to 40° C.

5. In an apparatus for crimping a filament yarn comprising a stuffing chamber having a hot fluid jet nozzle at one end thereof to plasticize and drive the filament yarn into said stuffing chamber and a hot fluid outlet to exhaust the hot fluid separated from the filament yarn supplied through said hot fluid jet nozzle, a staying control chamber disposed in communication with said stuffing chamber downstream thereof, said staying control chamber having a plurality of small outlet orifices for the exhaust of a cold fluid located in series along the length of said staying control chamber, the improvement comprising nozzle means located in said staying control chamber adjacent the end thereof opposite said stuffing chamber, a yarn intermingle bore extending through said nozzle means and having a diameter less than the diameter of said staying control chamber and at least two jet bores symmetrically intersecting said yarn intermingle bore radially at right angles thereto, said jet bores intersecting said yarn intermingle bore between the midpoint of said yarn intermingle bore and said staying control chamber and the ratio of the total cross-sectional area of the jet bores to the cross-sectional area of said yarn intermingle bore being from 0.80 to 1.23 whereby cold fluid may be injected into said bore through said jet bores to impact upon the filament yarn passing therethrough to impart filament cohesion to the yarn.

6. The apparatus of claim 5 wherein the diameter of the yarn intermingle bore is from 2 mm to 4 mm.

7. The apparatus of claim 5 wherein the diameter of each cold fluid jet bore is from 1.26 mm to 3.14 mm.

8. The apparatus of claim 5 wherein the ratio (AL/PL) of the distance (AL) between the center of the cold fluid jet bores and the inlet extremity of the yarn intermingle bore to the distance (PL) between the center of the cold fluid jet bores and the outlet extremity of the yarn intermingle bore, is from 0.05 to 0.9 inclusive.

9. The apparatus of claim 5 wherein the length (PL+AL) of the yarn intermingle bore is from 3 mm to 20 mm.

10. The apparatus of claim 5 wherein an outlet passageway is formed at the downstream end of the intermingle nozzle.

* * * * *